United States Patent [19]

DeWoolfson et al.

[11] Patent Number: 4,784,251

[45] Date of Patent: Nov. 15, 1988

[54] REVERSE VENDING MACHINE

[75] Inventors: Bruce H. DeWoolfson; Don Dawson, both of Vienna, Va.

[73] Assignee: Environmental Products Corporation, Fairfax, Va.

[21] Appl. No.: 4,348

[22] Filed: Jan. 16, 1987

[51] Int. Cl.[4] ..... G07F 7/06

[52] U.S. Cl. ..... 194/209; 194/212; 241/68; 241/81; 241/158

[58] Field of Search ..... 194/205, 208, 209, 212; 209/583, 930; 235/462, 464, 470; 241/68, 81, 158, 236; 100/902

[56] References Cited

U.S. PATENT DOCUMENTS

| | | | |
|---|---|---|---|
| 27,643 | 7/1967 | Myers . | |
| 1,598,364 | 3/1925 | Cassell et al. . | |
| 2,999,576 | 9/1961 | Glembring | 194/212 X |
| 3,015,376 | 1/1962 | Glembring | 194/212 X |
| 3,792,765 | 2/1974 | Arp | 194/209 |
| 3,907,087 | 9/1975 | Tanaka . | |
| 4,141,493 | 2/1979 | Arp . | |
| 4,241,821 | 12/1980 | Wu et al. . | |
| 4,245,731 | 1/1981 | Herbst et al. . | |
| 4,248,334 | 2/1981 | Hanley et al. . | |
| 4,248,389 | 2/1981 | Thompson et al. . | |
| 4,285,426 | 8/1981 | Cahill . | |
| 4,411,351 | 10/1983 | Lowder et al. | 194/212 |
| 4,412,608 | 11/1983 | Kaspar et al. | 194/212 X |
| 4,532,859 | 8/1985 | Solordal | 194/212 X |
| 4,560,112 | 12/1985 | Rouse et al. . | |
| 4,573,641 | 3/1986 | DeWoolfson et al. . | |
| 4,579,216 | 4/1986 | DeWoolfson et al. . | |
| 4,653,627 | 3/1987 | Hampson et al. | 194/209 |
| 4,669,673 | 6/1987 | Lodovico et al. | 241/236 X |

*Primary Examiner*—Joseph J. Rolla
*Assistant Examiner*—Edward S. Ammeen
*Attorney, Agent, or Firm*—Finnegan, Henderson, Farabow, Garrett & Dunner

[57] ABSTRACT

A reverse vending machine for comminuting plastic containers includes devices for identifying different sizes of container and bar codes at various locations on the container without manipulating the container. A container is dropped from a pivotable cradle end first and is physically engaged on diametrically opposite sides substantially simultaneously and forced into a mechanism for cutting the container into strips and then for cutting the strips into small pieces. The presence of the container, and the state and operation of the shredding apparatus, customer door, coin supply, and storage bins are continually monitored with appropriate action taken during operation.

23 Claims, 13 Drawing Sheets

B
270
IS DOOR SWITCH CLOSED ?
N
Y
271
FRONT CONTAINER DETECTOR SWITCH
272
IS CONTAINER WEIGHT OK ?
273
SCANNER OPERATING
274
IS SPINNER OPERATING
275
IS UPC ACCEPTABLE
276
C
278
275
280
REJECT
C
C
N
304
IS BIN FULL
FAIL
172
INCREMENT COUNTER
286
SHRED & GRANULATE
302
IS CONTAINER PRESENT
PUSH FOR PAYMENT

REVERSE VENDING MACHINE

BACKGROUND OF THE INVENTION

This invention relates to a reverse vending machine for comminuting and storing used containers and, more particularly, machines for comminuting and storing used plastic beverage containers and for dispensing coins or coupons in exchange for bottles so collected.

With the increased emphasis in recent years on environmental conservation, the control of unsightly litter, such as used beverage containers, has become an important factor in the conservation effort. As a result of these problems, many jurisdictions have now enacted mandatory deposit laws which require deposits on all beverage containers, including cans and bottles. Such laws create additional problems for the grocery industry, and a great deal of attention has been directed to the development of an efficient and effective method for receiving returned containers and paying the necessary deposit refunds. Returned containers must be stored and transported at an inordinate cost to grocery and other stores in terms of occupied floor space, labor, and material. Also, the storage of such used containers creates additional sanitation problems. A 1980 food marketing institute survey showed that food retailers in mandatory deposit jurisdictions were spending an average of 2.3 cents for every container which was turned in for refund.

Mandatory deposits also create substantial additional cost for the beverage bottler, including additional labor costs for handling returns, transportation and fuel costs, and warehousing costs. In 1979, the additional cost of handling returnables to the bottler was estimated at ten (10) cents per six pack.

Many problems have been encountered in designing a refund system encouraging the recovery and recycling of used beverage containers. In particular, the recovery and recycling of used plastic containers has presented a unique set of problems. For example, identification of acceptable containers has created problems. A uniform product code (UPC) is generally used as a means of identification. Due to the nature of plastic containers, the UPC is located on the label of the container. These labels are not affixed to plastic containers at a conventional location. Further, plastic containers exist in a wide variety of sizes and shapes. This adds to the problem of finding the location of the UPC on a container.

A second problem particular to the recovery and recycling or used plastic containers concerns the inherent light weight of plastic and the related difficulty of achieving a high bulk density in the storage area for the comminuted containers. The light weight of a plastic container creates problems in comminuting due to difficulty in grasping the container and its tendency to bounce around within the machine. Also, the storage areas for the comminuted plastic containers tend to fill up quickly because the containers are not comminuted in a manner which results in a high bulk density.

Several machines have been developed in the prior art for encouraging the recycling and recovery of used beverage containers. For example, U.S. Pat. Nos. 3,857,334 and 3,907,087 disclose apparatus for crushing metallic containers and discharging refund coins or tokens in exchange therefore. U.S. Pat. No. Re 27,643 describes a process and apparatus for collection of metal containers in which tokens are automatically dispensed for containers collected.

Prior art devices are known which reduce the size of plastic containers. For example, U.S. Pat. No. 4,285,426 discloses a container redemption apparatus which scans and detects code markings on plastic containers to determine whether they are of an acceptable type. If the containers are determined to be acceptable, they are swept into a comminuter or shredder where they will be reduced in size. Such a prior art device does not achieve the desired bulk density (pounds per unit volume) in the storage area and is relatively complicated in its construction and operation. As a result, this prior art device requires frequent maintenance and service, which needlessly increases the cost of recycling the used plastic containers.

SUMMARY OF THE INVENTION

Accordingly, it is a primary object of this invention to provide an improved reverse vending machine which is capable of readily identifying and accepting plastic containers and which efficiently reduces the size of accepted containers to achieve a high bulk density in the storage containers.

It is a further object of this invention to provide a reverse vending machine which can detect the presence of a specified identifying indicia (UPC) on practically all common types of plastic containers and can receive and reduce in size the accepted containers. Another object of this invention is to collect used plastic containers and automatically pay a predetermined refund deposit applicable to the collected containers.

Additional objects and advantages of the invention will be set forth in part in the description which follows and in part will be obvious from the description, or may be learned by practice of the invention.

To achieve the foregoing objects and in accordance with the purpose of the invention as embodied and broadly described herein, the machine of this invention comprises a housing with means in the housing for receiving and supporting a container; identifying means disposed in the housing for identifying a received container in the receiving and supporting means; means in the housing governed by the identifying means for accepting a received container; dispensing means in the housing for dispensing consideration in response to acceptance of a received container; means responsive to the acceptance of a container for causing the receiving and supporting means to move the accepted container to a predetermined position in the housing; first cutting means disposed adjacent the predetermined position for cutting the container longitudinally into a plurality of elongated strips of a predetermined width; second cutting means, disposed to receive the elongated strips, for cutting the strips at an angle to the longitudinal cut to comminute each strip into a plurality of pieces; and means for storing the pieces received from the second cutting means.

Preferably, the machine has a container receiving area including an entry port communicating with the interior of the housing and a vend mechanism for receiving and supporting the plastic container and transferring it to the cutting means. It is preferred that the identifying means include means to compare the weight of the received container to predetermined weight limits and scanning means, including means to manipulate the container, for reading an identifying indicia such as a uniform product code (UPC).

Preferably, the accepting means includes a vend mechanism for transferring the container to the cutting means when the container is of a predetermined identity. The first cutting means also preferably includes feed paddles for forcing the plastic container between the cutters of the first cutting means.

BRIEF DESCRIPTION OF THE DRAWINGS

The accompanying drawings, which are incorporated in and constitute a part of the specification, illustrate one embodiment of the invention, and together with the description, serve to explain the principles of this invention.

FIGS. is 13A–13G are flowcharts illustrating the various details in the operation of the reverse vending machine as controlled by the microprocessor in accordance with the present preferred embodiment of the invention.

DESCRIPTION OF THE PREFERRED EMBODIMENT

Figure 2:
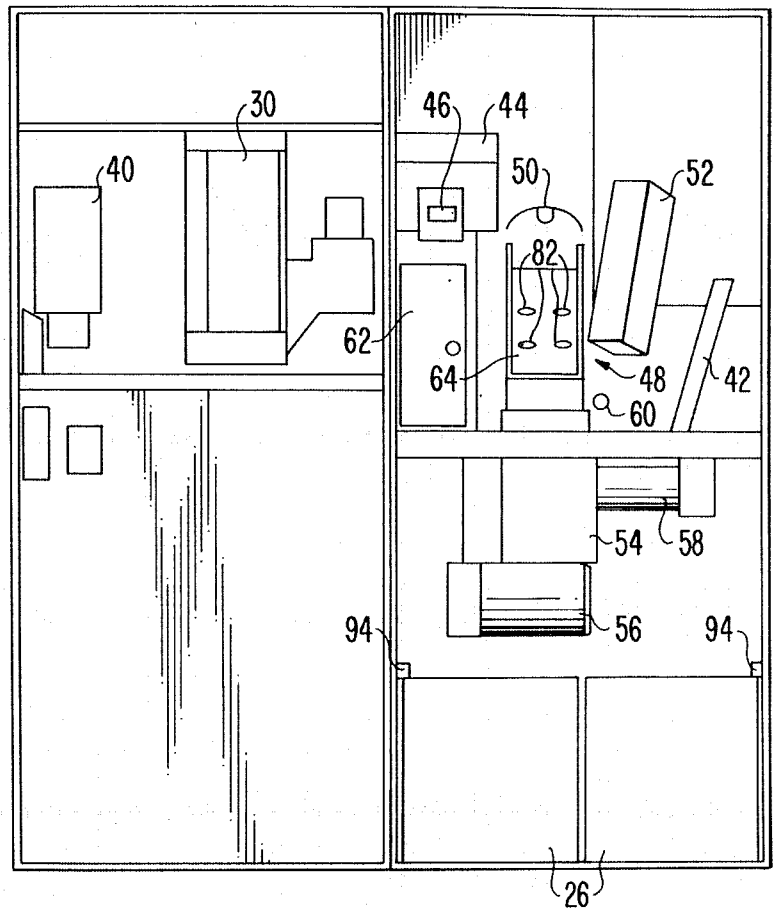
FIG. 2 is a front view of the interior portion of the machine and the rear of the front door.

Reference will now be made to the present preferred embodiment of the invention which comprises a reverse vending machine for accepting and comminuting plastic containers of a predetermined identity and for issuing consideration therefor. As embodied herein, and referring to FIGS. 1 and 2, a machine 20 includes a rectangular cabinet 22 having a front wall 24 which is hinged to allow access to the interior of the cabinet as shown in FIG. 2, for maintenance of the operating components, replenishment of the consideration, and removal of the comminuted plastic containers stored in collection boxes 26. Front wall 24 includes a customer door 28, which is preferable biased to its closed position; and which is opened to insert a container such as 29 through an access opening or entry port 30 in front wall 24. A push button 32 provided for operation by the customer to signal when a coin refund is due through a slot 34. A push button 36 is provided for the customer to request a coupon consideration for a plurality of plastic containers, such as 29, which are deposited through opening 38. Mounted inside the cabinet as shown in FIG. 2 is a coin dispenser 40 which communicates with a coin chute 42 when front wall 24 is closed for directing the coins to slot 34. A coupon dispenser 44 has a feed slot 46 which aligns with opening 38 when front wall 24 is closed for dispensing the coupons.

Figure 1:
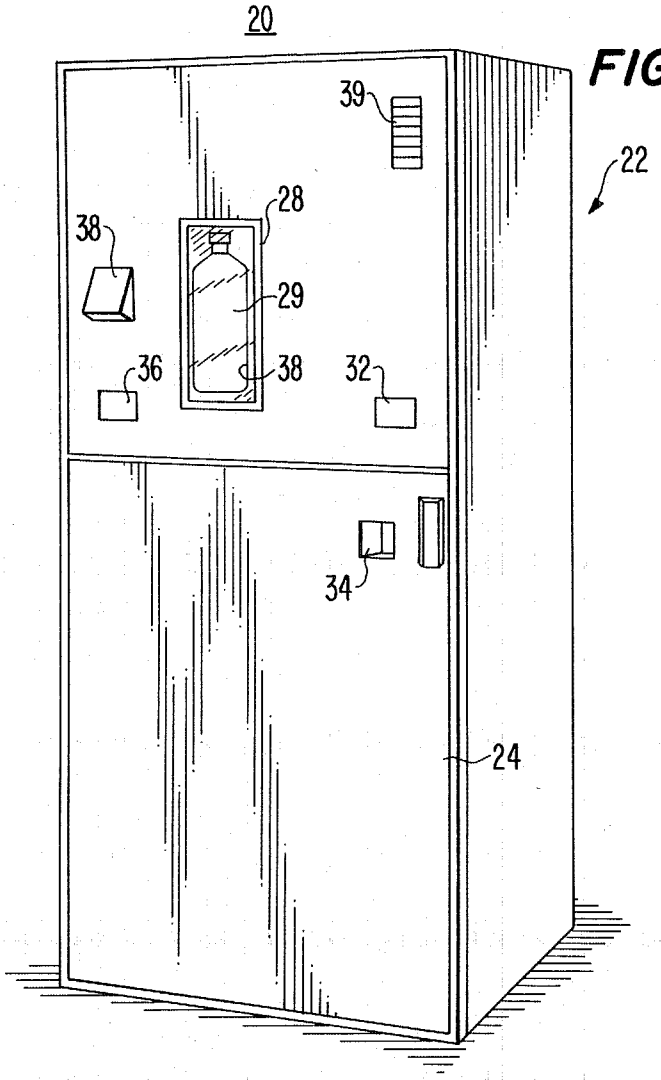
FIG. 1 is a frontal perspective view of the exterior of the machine.

Machine 20 of the present invention includes means in cabinet or housing 22 for receiving and supporting a plastic container offered by a customer. As here embodied, and as shown in FIGS. 1 and 2, such receiving and supporting me includes customer door 28, entry port 30, and a vend mechanism 48 for supporting the plastic container after being inserted through entry port 30. As shown in FIG. 2, vend mechanism 48 is in its "down" position for alignment with entry port 30 when front wall 24 is closed. A front acoustic sensor 50 is provided to sense a container in the vend mechanism 48; and a laser scanning mechanism 52 is mounted adjacent vend mechanism 48 for scanning indicia such as a bar code on a label of plastic container such as 29. In the lower portion of cabinet 22, and in accordance with the present invention, is a feeding and shredding apparatus 54 positioned below vend mechanism 48, and a granular 56 position below shredder 54. A reversible AC motor referred to at 58 is provided to drive the feeding and shredding mechanisms. Between shredder 54 and vend mechanism 48 is a rear acoustic sensor 60 which detects a container being fed into the shredding mechanism. A cabinet is provided to house the control apparatus or operating machine 20 as described hereinafter.

Figure 3:
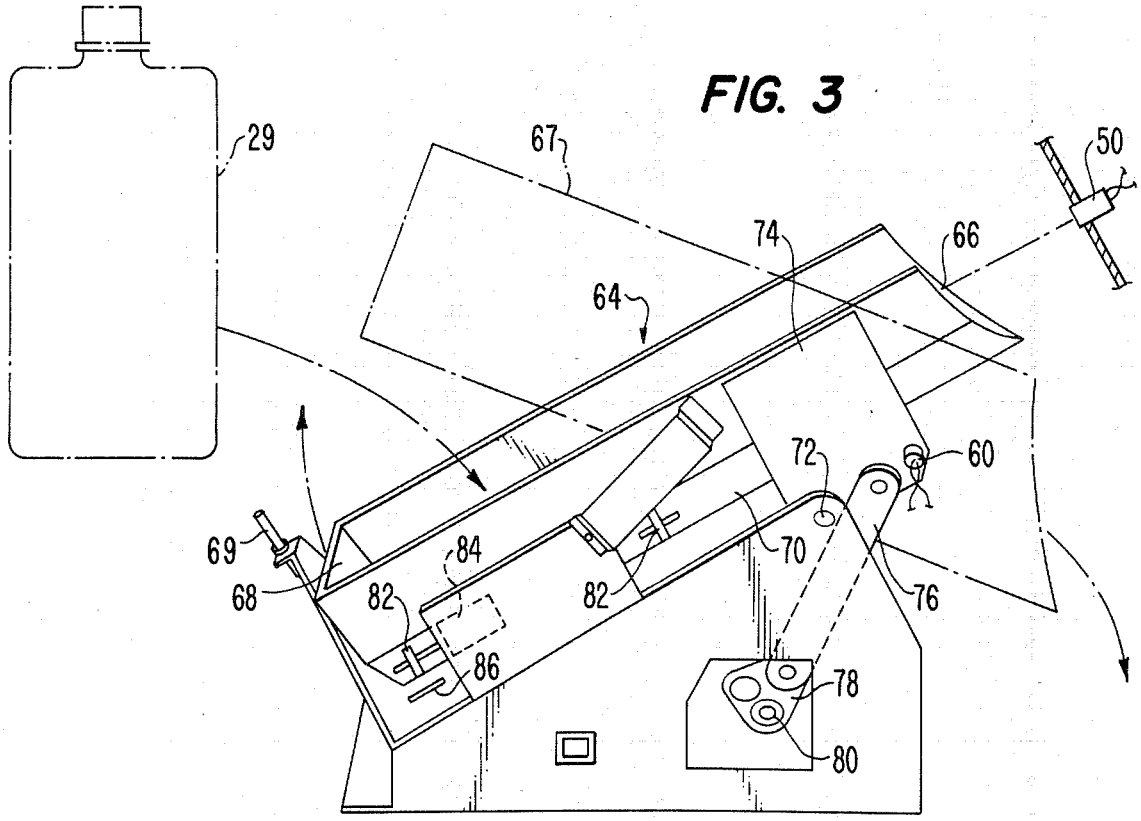
FIG. 3 is a perspective view of the vend mechanism.

Referring to FIG. 3, vend mechanism 48 includes a pivotably mounted, elongated open receptacle 64 with an open back end 66, a closed front end 68 and a bottom 70 slanted inwardly from the sides to form a trough having a V-shaped cross-section. Vend mechanism 48 as shown in FIG. 3 is pivotably mounted at pin 72 and is operable to move between a first position (down), as shown by the solid lines, and a second position (up), as shown by the dashed lines. Cradle 64 has a bracket 74 that is connected by a link 76 to an eccentric type member 78 that is connected to a pin 80 that is rotated by a non-reversible AC motor (not shown) for rotating member 78 clockwise as shown in the drawing to tip cradle 64 to its up position for dumping container 29 out of open end 66.

Associated with vend mechanism 48 are identifying means disposed in the housing for identifying a received container in the vend mechanism. As embodied herein, and referring to FIGS. 2 and 3, the identifying means includes front acoustic sensor 50, heretofore mentioned, located beyond open end 66 for sensing the presence of a container 29 in the vend mechanism. As embodied herein, a single ultrasonic beam is sent along the longitudinal axis of cradle 46 is reflected back to transducer 50. The time required for an echo to return to the transducer 50 is compared with a known time or reference period to determine if a container is present in the cradle 64.

The identifying means of the present invention further includes an optical scanner for detecting the presence of identifying indicia on a label of a plastic container 29 in cradle 64. The position of transducer 50 permits the detection of all sizes of containers in cradle 64. Low power laser scanning device 52 is positioned adjacent the vend mechanism for identifying a code on the label of the container. The scanning device when activated produces a red crosshatch pattern on the surface of the container. The scanning device is positioned so as to scan an area of the container beginning at front end 68 of cradle 64 and extending rearwardly along the longitudinal axis of a container a predetermined distance so that UPC of codes that are placed at different positions on the container, as well as various length containers, can be read. Scanner 52 includes a set of optical prisms (not shown) arranged to read a universal bar code on a curved container surface as it passes the scanner.

The identifying means of the present invention also includes a bottle spinner mechanism including a plurality of rubber wheels 82 in trough 70 of the cradle to spin a container on its axis so that the UPC code may revolve to the optimum reading location for the scanner 52 without manipulation by the customer. A 12-volt D.C. motor 84 drives all of the rubber wheels.

The identifying means of the invention also includes weighing means for determining whether the weight of the received container falls within predefined limits. As shown in FIG. 3, the weighing means include an adjustable spring (not shown) which supports the spinner wheels. The spring is adjusted so that an overweight bottle will cause the spinner mechanism to be pressed down closing a microswitch such as 86 which gives an overweight signal. An overweight container must be removed before operations can continue.

The invention includes means in the housing governed by the identifying means for accepting a received container. As embodied herein, such accepting means is controlled by a conventional microprocessor and associated circuitry housed in cabinet 22, the inputs and outputs of which and the program therefor as it controls the operation of the machine will be described hereinafter.

The invention further includes means responsive to the acceptance of a container for moving the accepted container to a predetermined position in the housing. As embodied herein, a container such as 29 slides through open end 66 of cradle 64 upon pivoting of the cradle to its up position as indicated in FIG. 3 by the dashed outline referred to at 67. As the container slides out of cradle 64 and into the mouth of shredder 54, rear sonic transducer 60 senses the container entering shredder apparatus 54. Transducer 60 is mounted on the housing surrounding the vend mechanism as shown in FIG. 3, and sends an ultrasonic beam across the mouth of the shredder, the time of receipt of the echo indicates whether or not the opening to the shredder is clear.

Figure 4:
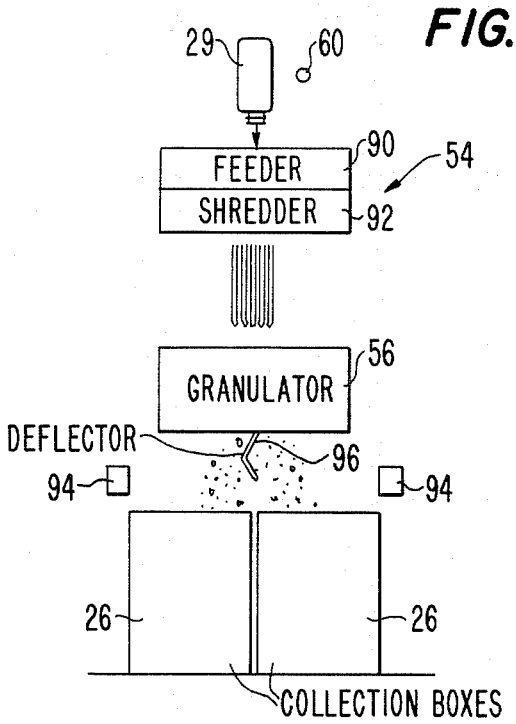
FIG. 4 is a schematic diagram showing the container in its various stages as it proceeds through the shredder into the granulator and, lastly into the collection boxes.

In accordance with the invention, means are provided for comminuting an accepted container to reduce its size and arrive at a desirable bulk density in the storage area. As embodied herein, and referring to FIG. 4, size reduction of the plastic container is done through a two stage process. First cutting means includes shredding means 54 having a feeding apparatus 90 and a shredder is disposed to receive a container, such as 29, dumped for forcing the container into the shredder for cutting the container longitudinally into a plurality of strips of predetermined width. A commercial shredder such as that manufactured by Allegheny Paper Shredders, Inc. as Model No. APS-508 may be utilized.

Second cutting means includes granulator 56, disposed to receive elongated strips from shredder 92. Granulator 56 cuts each of the strips at an angle to the longitudinal cut of the shredder to comminute each strip into a plurality of pieces. A commercial granulator such as that manufactured by Allegheny Paper Shredders, Inc. as Model No. APS-688 may be utilized as modified herein. Storage means are also provided for receiving the comminuted containers from granulator 56. As previously mentioned, such means may include two boxes 26 lined with plastic bags positioned in the lower portion of the housing directly underneath granulator 56.

Preferably, bin-full sensors 94 are included to detect when the storage areas are full. An infra-red emitter and detector pair are fastened to the cabinet sides. The sensor is used after each bottle is collected to detect a bin-full condition when this beam is blocked. When a bin-full condition is detected, the machine is prevented from accepting further containers.

A deflector 96 is positioned above collection boxes 26 below granulator 56 for deflecting the small pieces of plastic to minimize the piling of the small pieces in one place in the containers. The deflector 96 is comprised of a plate that has an upper portion at one angle and a bent lower portion extending at another angle relative to the vertical.

Figure 5:
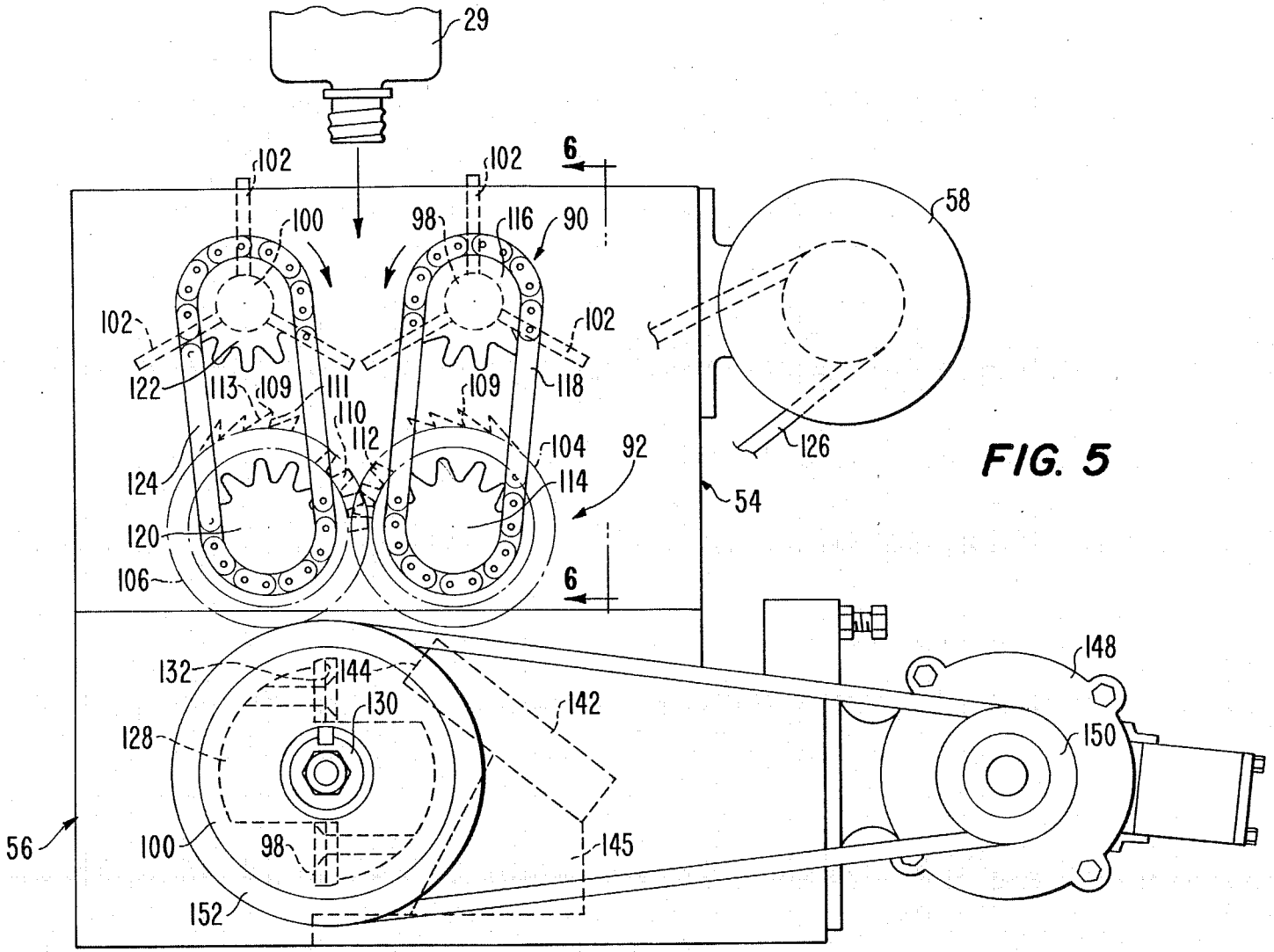
FIG. 5 is a side view of the feeder, the shredder and the granulator with a fragmentary view of a container in the position to be comminuted.
Figure 6:
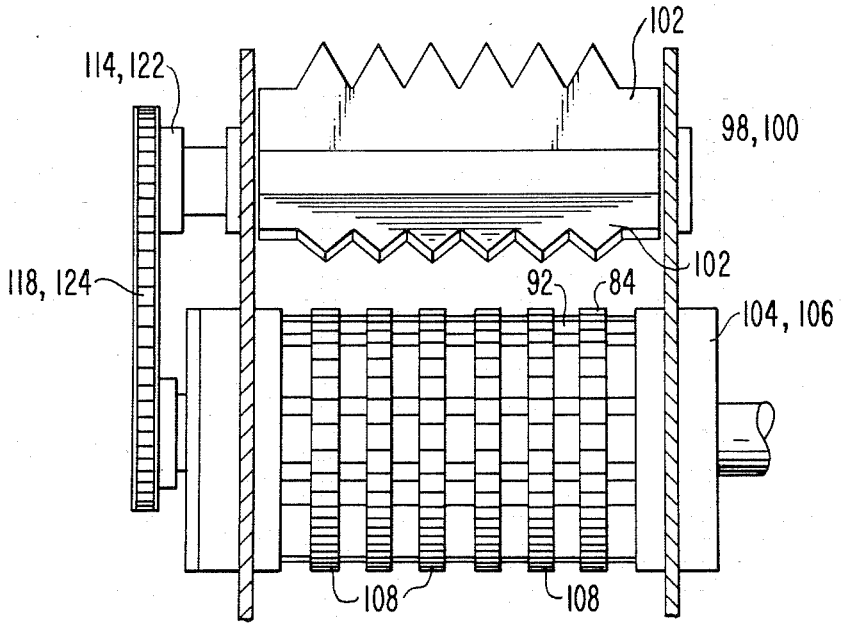
FIG. 6 is a front view of a feeder blade and one of the rotary blades for the shredding mechanism.
Figure 8:
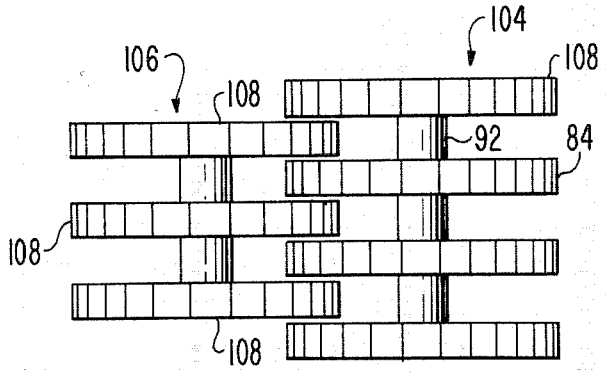
FIG. 8 is a container eyes view of the rotary cutting blade assembly of the shredder.

Referring to FIG. 5, feeder 90 comprises a pair of parallel rotatable shafts 98 and 100. Each of the shafts 98 and 100 have radially extending paddles 102 spaced 120° apart on their respective shafts. Shafts 100 and 102 are mounted relative to one another such that the paddles 102 mesh when the shafts are rotated in opposite directions. As shown in FIG. 6, each of the paddles 102 is comprised of a row of saw tooth edges adjacent one another. Each saw tooth has an apex that is formed at approximately a 60° angle with the number of saw teeth corresponding to the axial length of the paddle. In one preferred embodiment of the present invention, each saw tooth from the base to the apex is approximately 2 inches and the axial distance between adjacent teeth at the outer edge is approximately 2 inches. Upon rotation of the shafts 98 and 100 in opposite directions, the teeth of the paddles mesh slightly with space between opposing outer edges. The angular relationship of each of the shafts 98 and 100 is such that corresponding paddles 102 extend substantially parallel to one another and parallel to the path of the traveling container 29 as it leaves cradle 64 to be comminuted. With this relationship, the container is kept centrally positioned relative to the shredder; and the paddles do not push the container laterally. Shredder 92 comprises a pair of rotating drum-like shafts 104 and 106 (see also FIG. 6 and FIG. 8). Each of the drums has a plurality of axially spaced blades 108, with integral angularspaced radially-extending teeth 109 having leading edges 111 and trailing edges 113. Teeth 109 engage, propel and cut containers 29.

Drums 104 and 106 are positioned relative to one another and blades 108 of shafts 104 and 106 are spaced relative to one another such that the blades of one drum mesh with the blades of another in a cutting relationship. The counter-rotation of the drums 104 and 106 toward one another slices container, such as 29 into elongate strips that correspond to the width between individual blades 108. Adjacent one end of each of the drums 104 and 106 are meshed gears 110 and 112 for transferring the driving force from one drum shaft such as 104 to the other drum shaft 106. Sprockets 114 and 116 are connected by a chain 118 so that the rotation of drum 104 drives shaft 98 of the feed mechanism 90. Similarly, sprockets 120 and 122 are connected by a chain 124 so that driven gear 110 drives shaft 100. Thus, with the meshing of gears 110 and 112 and the positive chain drives 118 and 124 through sprockets 114 and 120, respectively, the shredding blades and the paddles are kept in proper relationship to each other for feeding and shredding the container. Motor 58 drives a speed reduction gearbox. The output of the gearbox drives shaft 104. In the preferred embodiment, the feeder and shredder 54 rotate at about 35 rpm.

Figure 9:
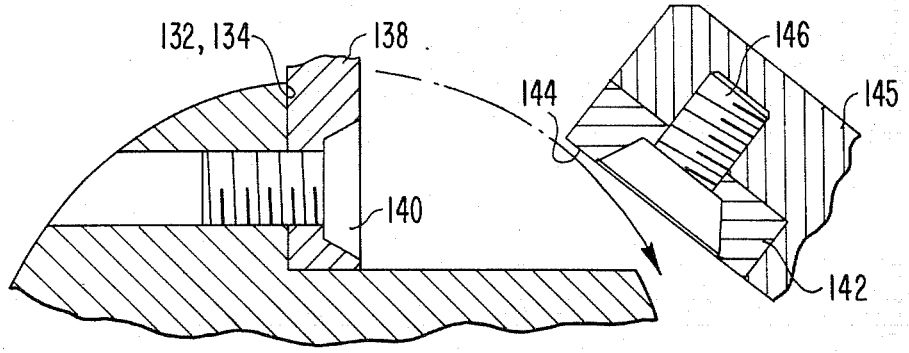
FIG. 9 is an enlarged fragmentary sectional view taken on line 9—9 of FIG. 7 blade of the granulator mechanism.
Figure 7:
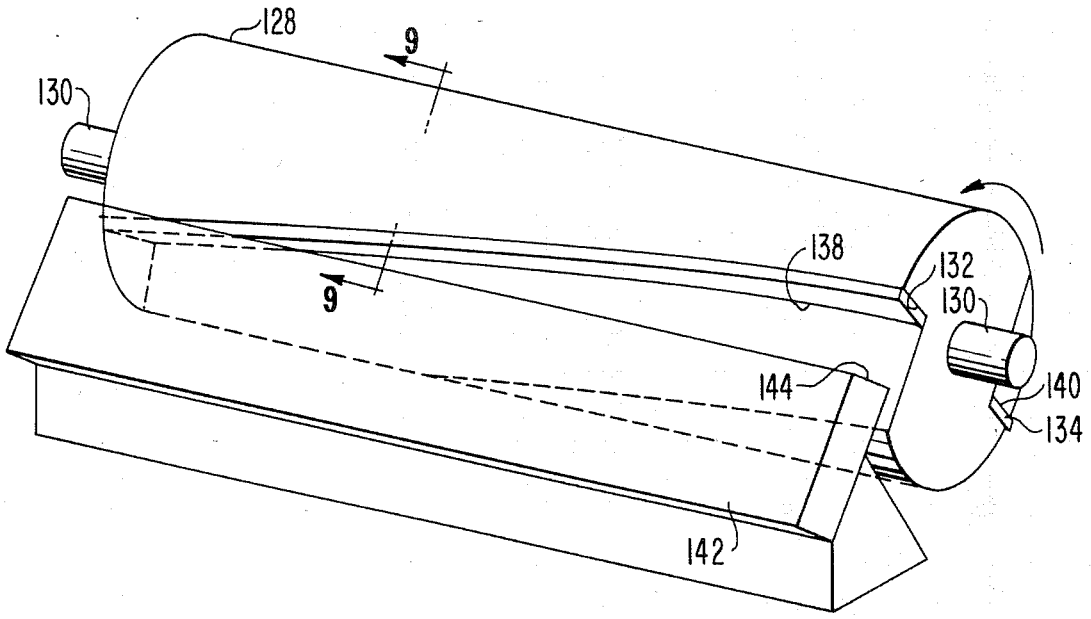
FIG. 7 is a perspective view of the rotary and stationary blade of the granulator.

Granulator 56 which is positioned below shredder 92 comprises a cylindrical shaft 128 having end portions 130 of reduced diameter (see FIG. 7). Cylindrical shaft 128 has a radially extending shoulder 132 that curves throughout its axial length so that one end of the shoulder is at a different angular position than the opposite end with respect to the circumference of the cylindrical shaft. A shoulder 134 similar to 132 is formed exactly 180° therefrom. Thus, shoulders 132 and 134 are diametrically opposed to each other along their axial length. Each shoulder 132 and 134 has a planar base surface that extends to the circumferential surface of cylinder 28 at approximately a 90° angle. A cutter blade 138 and 140 is fastened to each respective shoulder 132 and 134 by counter-sunk screws 140 (see FIG. 9). A fixed blade 142 which has a cutting edge 144 is mounted relative to the circumferential surface 128 such that cutting edge 144 is in sheering engagement with cutting edge of blade 138 as cylinder 128 rotates in the direction as shown by the arrow of FIGS. 7 and 9. Blade 142 is fastened to a base member 145 by counter-sunk screws such as 146. Motor 148 drives cylinder 128 through pulleys 150 and 152 mounted on the motor shaft and the reduced diameter 130 of the cylindrical shaft 128.

The speed of the cylindrical shaft 128 and thus knife blade 142 determine the ultimate size of the comminuted container. After each strip is cut by granulator 56, the pieces fall out of the bottom and into a material collection box 26 which includes preferably a deflector 96 to distribute the falling pieces over an enlarged area shown in FIG. 4. In the preferred embodiment, the granulator 56 rotates at about 1200 rpm.

Figure 10:
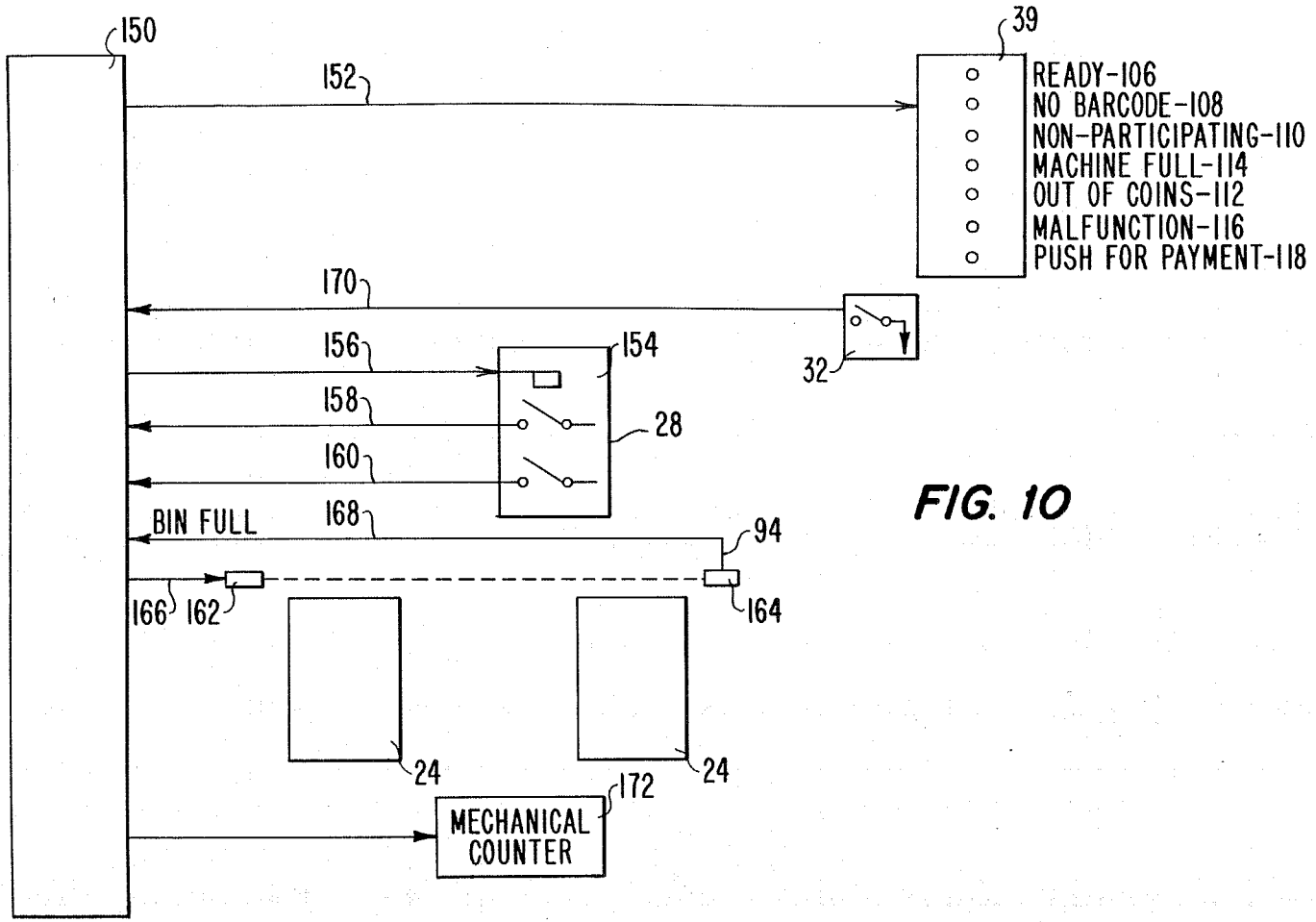
FIG. 10 is a schematic diagram illustrating inputs and outputs to the microprocessor/controller/input/output box relating the operation of the indicator lamps, customer door, bin full, and container counter mechanism of the reverse vending machine of the present embodiment of the invention.
Figure 11:
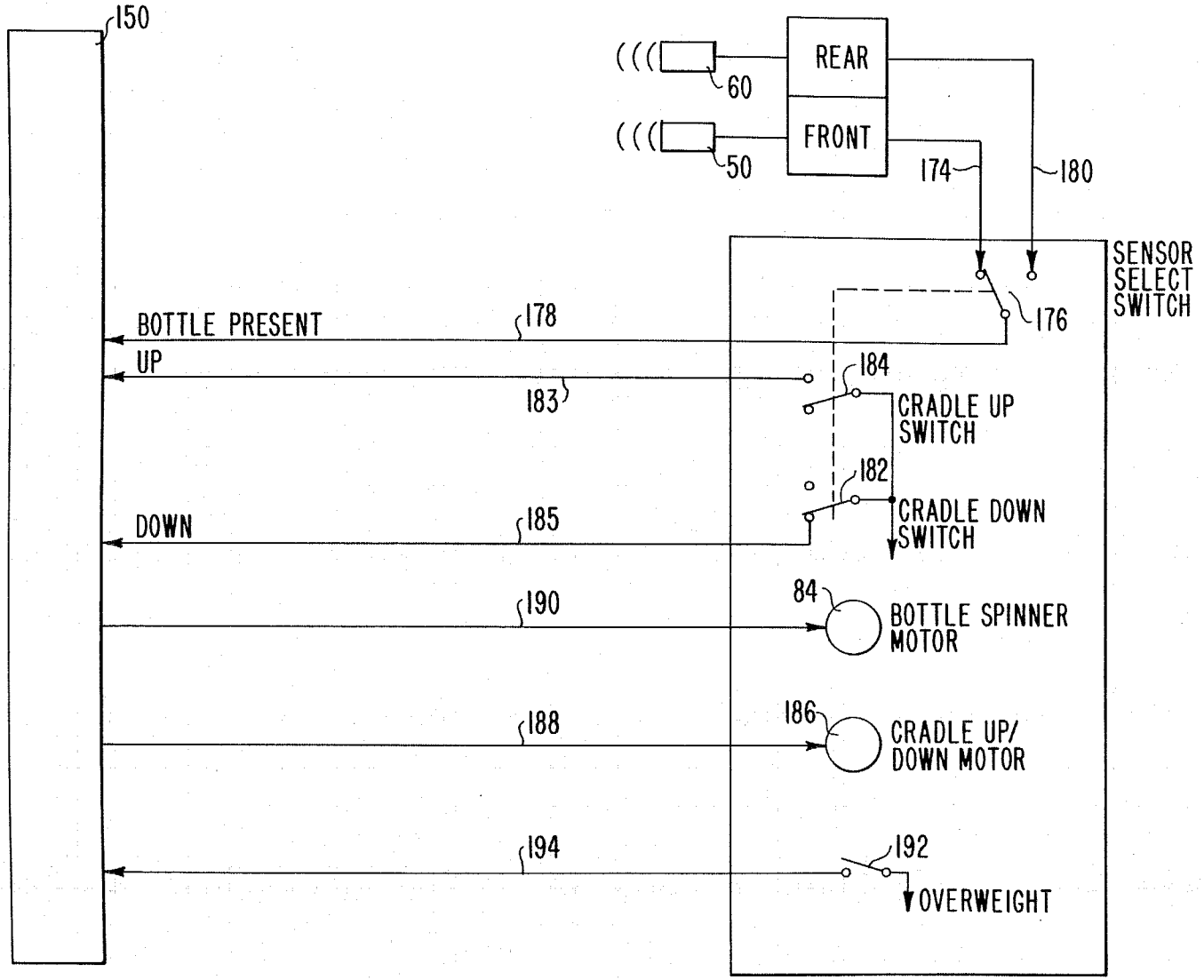
FIG. 11 is a schematic diagram illustrating the inputs and outputs to the controller input/output box relating to the operation of the vending mechanism, and associated sensors.
Figure 12:
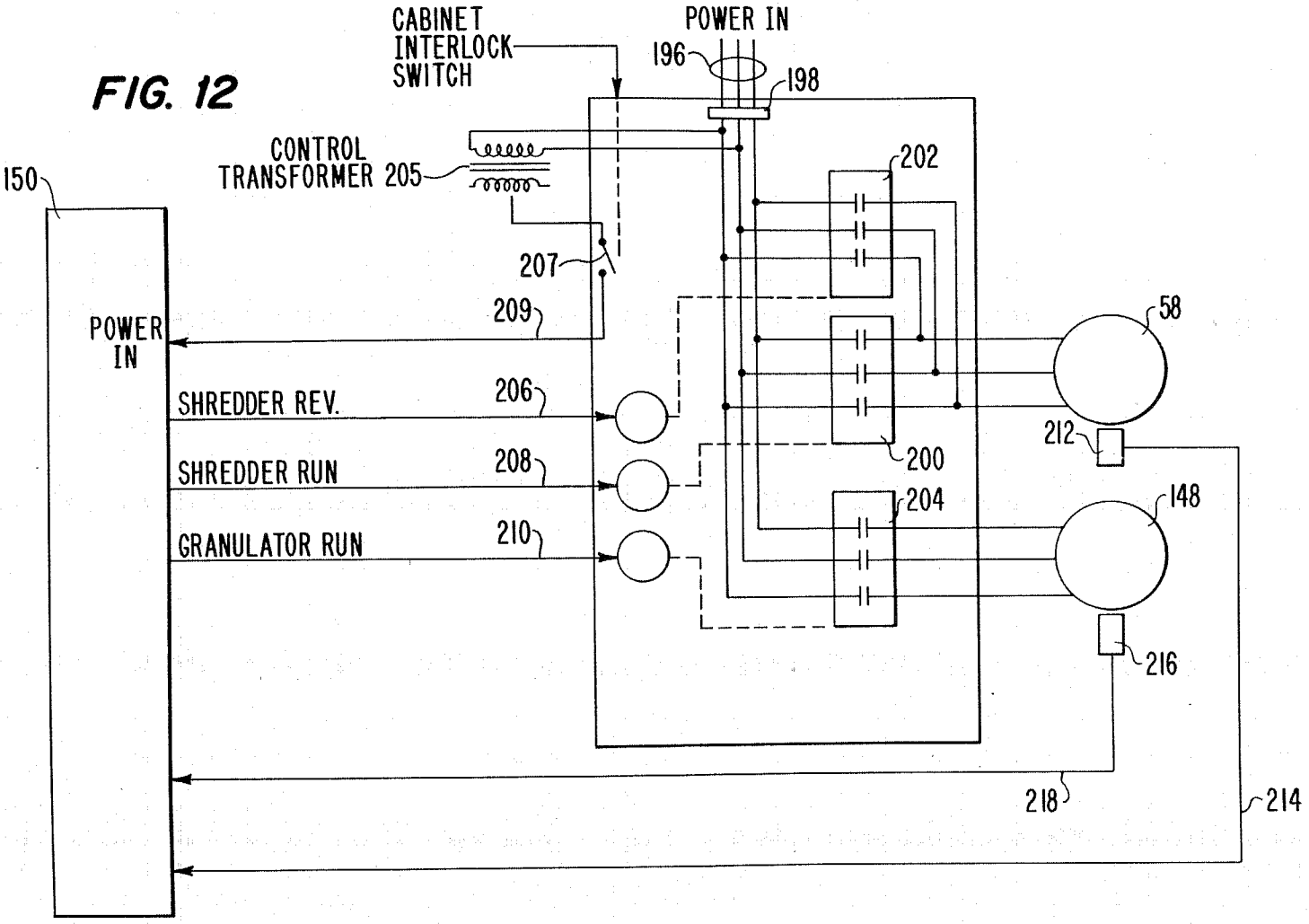
FIG. 12 is a schematic diagram illustrating inputs and outputs for control of the shredder and granulator of the reverse vending mechanism of the present embodiment of the invention.

The individual components described in connection with FIGS. 1 through 9 operate to input indications of their operated state and to be controlled in accordance with such input information by a microprocessor/controller through input/output circuitry generally referred to at 150; as shown in FIGS. 10 through 12.

Referring to FIG. 10, lamp indicator panel 39 is controlled by controller 150 over output line 152. Customer door 28 includes a locking solenoid 154 controlled over line 156 for locking and unlocking the door. The locked or unlocked state of door 28 is input to controller 150 over lines 158 and the open or closed state of the door is input over line 160. Bin full sensor 94 receives its power to activate an infrared emitter 162 and receiver 164 over line 166 and indicates a blocked or unblocked condition over input line 168. Operation of "Press for Payment" switch 32 is input over line 170, and the number of containers comminuted by the present invention are kept track of by a counter 172.

Referring to FIG. 11, front acoustic sensor 50 inputs the presence or absence of a container in cradle 64 over line 174, through closed switch contact 176, and line 178 to controller 150. Rear acoustic sensor 60 inputs the blocking or unblocking of a container at the mouth of shredding assembly 54 over line 180, switch contact 176, and 1 178. The position of contact 176 is controlled by the position of cradle 64. When, cradle 64 is in its down position, front acoustic sensor 50 is able to control the input to the controller; and when cradle 64 is in its up or dumping position, rear acoustic sensor 60 is able to input the detection of a container to the controller. Operation of a motor 186 for operating cradle 64 to the up position is controlled over line 188. The up position of cradle 64 is input over line 183, and the down position is input over line 185. Motor 84 for rotating or spinning a container on its axis while in cradle 64 is activated over line 190. An overweight switch 192 is closed if the container is too heavy: and such an indication is input over line 194.

Referring to FIG. 12, shredder motor 58 and granulator motor 148 is shown as being a 220 volt three phase AC motor powered over input line 196 through main circuit breaker 198. Power to motor 58 is input from circuit breaker 198 through closed contacts of relay 200 for operating feeder and shredder 54 in the normal or forward condition; and input through closed contacts of relay 202 for operating feeder/shredder 54 in the reverse direction to disgorge a container, or clear a jammed feeder and cutter mechanism. Motor 148 for granulator 56 is energized through closed contacts of rely 204 for operating in a forward or normal direction only.

The power for operating the apparatus other than the shredder and granulator is input through circuit breaker 198, step down transformer 205, closed switch contact 207, which indicates that door 22 is closed and input line 209 to the controller.

Relay 202 is controlled to operate motor 58 in the reverse direction over output line 206; and relay 200 is controlled to operate motor 58 in the forward direction over output line 208. Relay 204 is controlled over output 210 for controlling motor 148 of granulator 56. Motor 58 is provided with an RPM sensor 212 for inputting the speed of the motor over input line 214 to controller 150. Motor 148 is provided with an RPM sensor 216 to indicate to the controller over input line 218, the speed of the motor.

In order to obtain a more detailed understanding of the present preferred embodiment of the invention, reference will be made to the flow charts of FIGS. 13A through 13G in connection with a description of its operation.

Figure 13A:
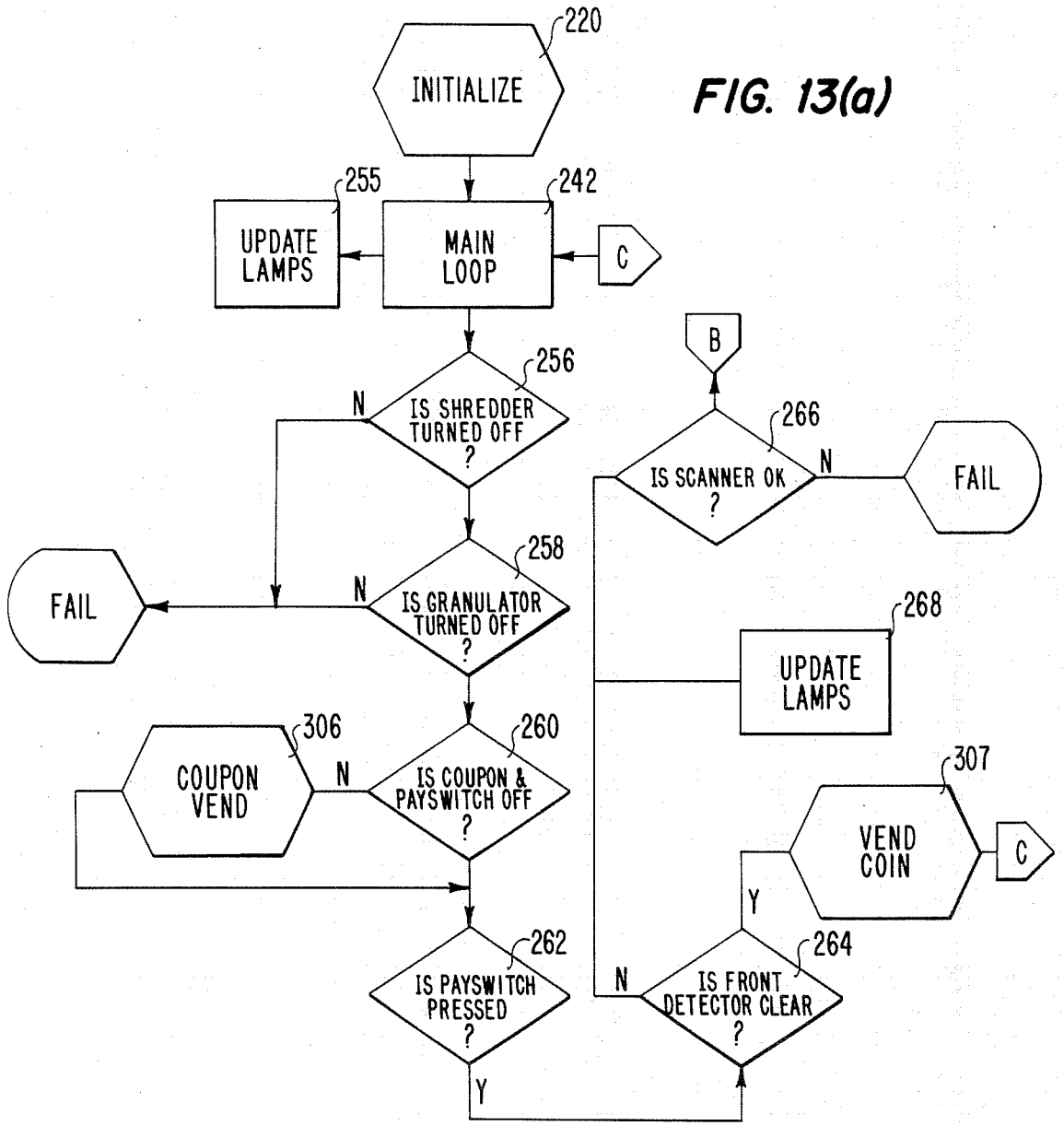
Figure 13B:
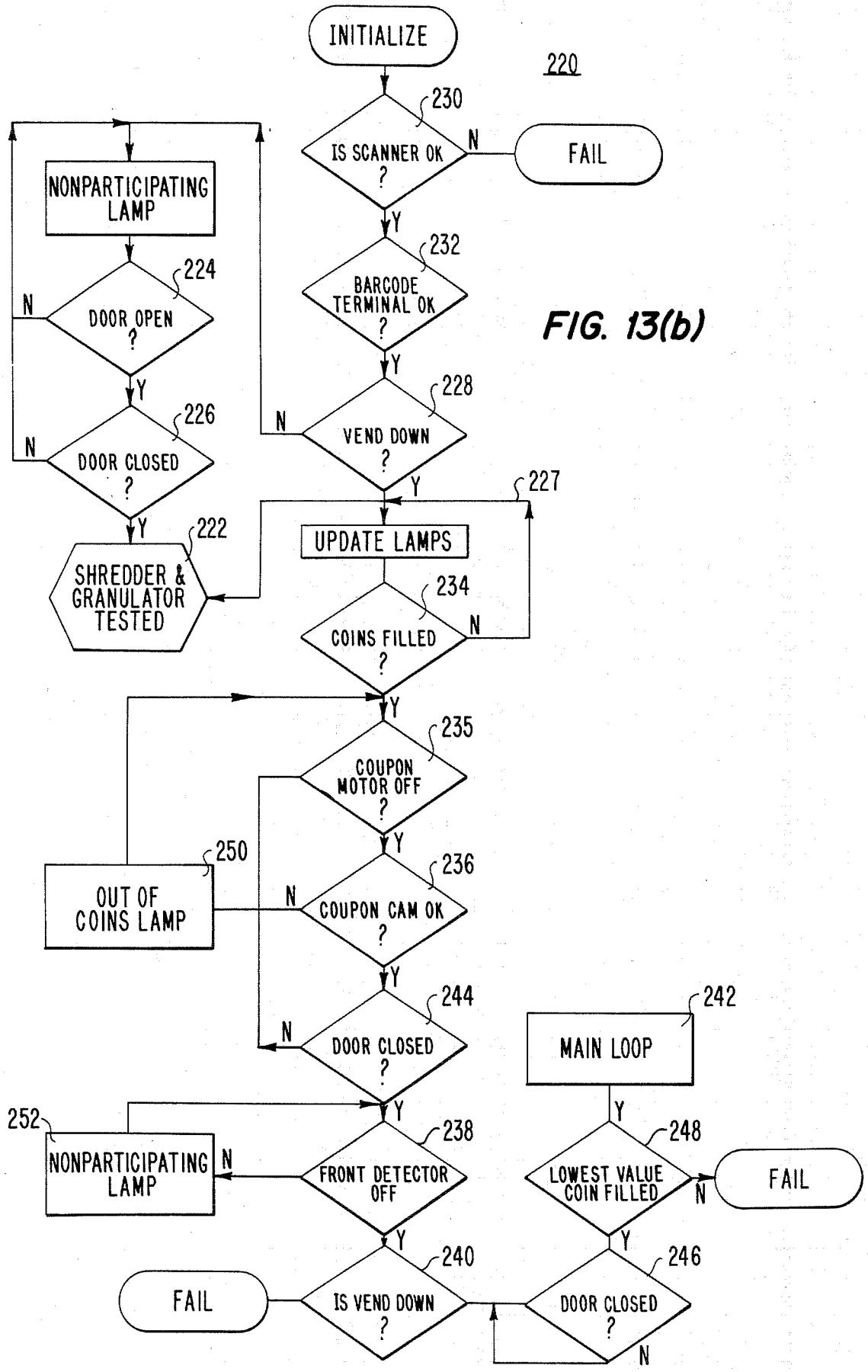
Figure 13C:
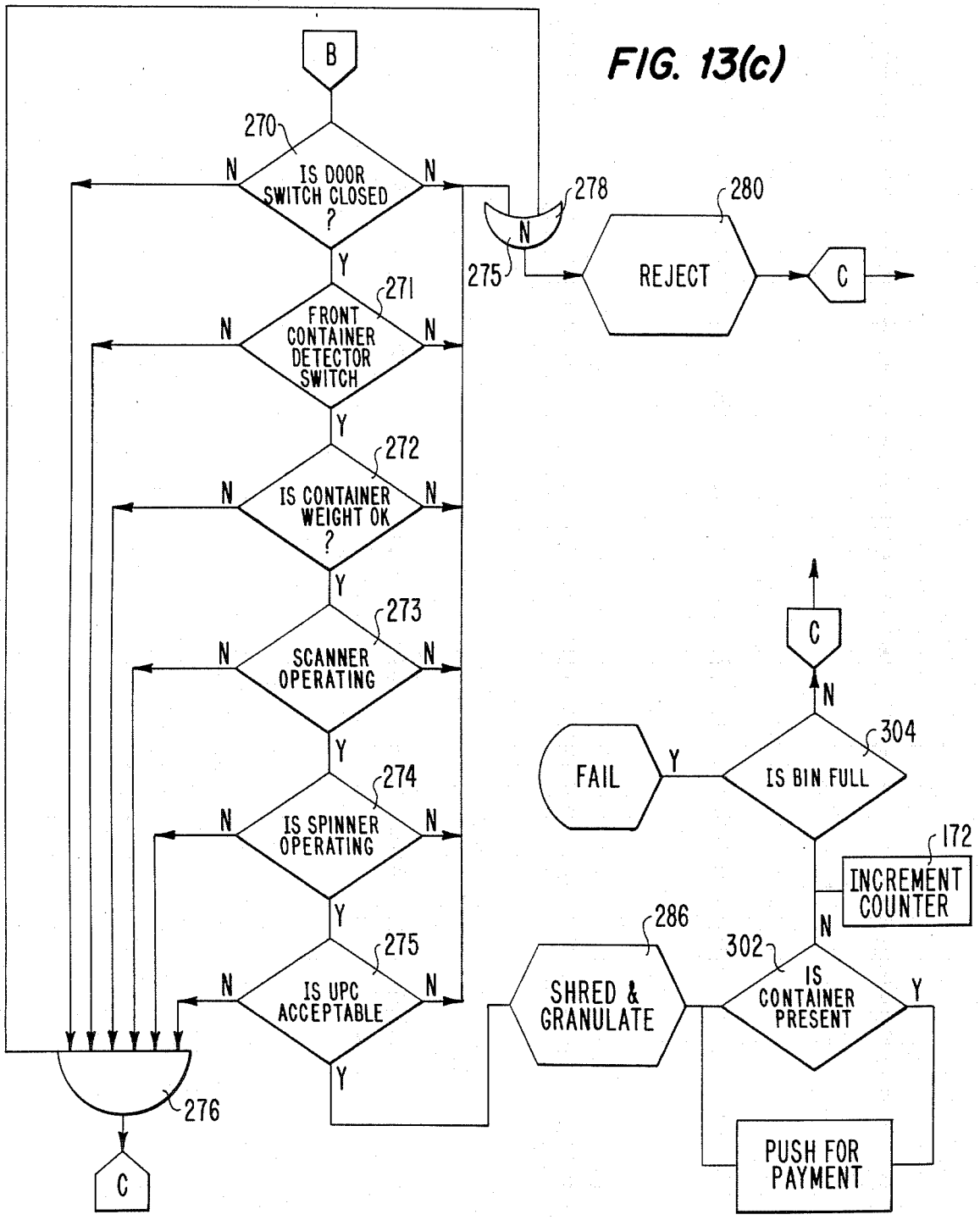
Figure 13D:
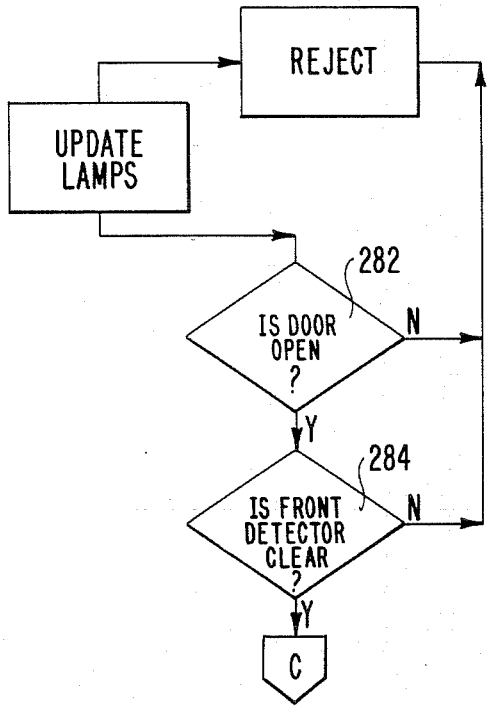
Figure 13G:
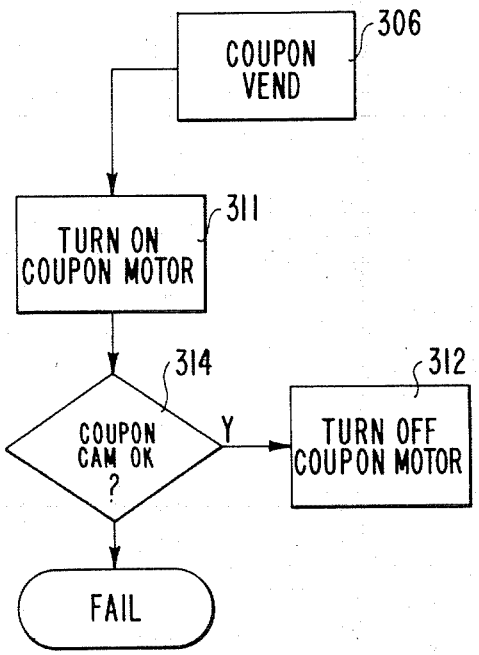

When first turning machine 20 on, and referring to FIG. 13A, microprocessor/controller 150 cycles through an initialization phase as indicated at block 220. During such phase, and referring to FIG. 13B, motor 58 and granulator motor 148 are turned on momentarily as indicated at block 222 after customer 28 door is opened and closed as indicated at blocks 224 and 226, or over line 227 if cradle 64 is in the down position, as determined at block 228. Scanning mechanism 53 (FIG. 1) is tested at sequential decision blocks 230 and 232. If the cradle 64 is not in the normal or down position, as indicated at block 228, "Nonparticipating" lamp flashes until door 28 is first opened and then closed, then the above stated crusher movement occurs. Coupon dispenser 44 is checked at decision blocks 234 through 236. Then, if detector 50 does not detect a container as required at block 238, and cradle 64 is in the down position as required at block 240, the program exits to a main loop indicated at block 242, provided that customer door 28 is closed as indicated by decision blocks 244 and 246, and the lowest values of coins are filled in coin dispenser 40 as required at block 248.

In the event, coupon dispenser 44 is not off, an indicator lamp flashes, and in the event front detector 50 indicates the presence of a container, a lamp flashes as shown at blocks 250 and 252. However, if block 230 indicates scanner 52 failure, or block 240 indicates a vend mechanism 48 failure, or the lowest value coin dispenser is not filled, machine 20 goes into a failure mode. Thus, as soon as customer door 28 is closed, and there are coins in the low value coin machine, and the laser scanner 52 is operational, and the shredder and granulator 54 and 56 are ready, the "Machine Ready" lamp is illuminated at 255 and the program enters the main loop of the program at 242.

While machine 20 is awaiting the insertion of a container and referring again to FIG. 13A, shredder and granulator motors are checked at blocks 256 and 258. Coupon switch 36 and coin switch 32 are checked at decision blocks 260 and 262. Cradle 64 is checked for a container at block 264 and scanner 52 is checked at 266, and indicator lamps are updated at 268.

If the door is opened, a bottle is present and is not overweight, then the scanner and spinner routine is started.

As soon as door 28 is opened, the laser scanner motor turns on, and under normal operation, decision blocks 270 through 275 are, in the affirmative upon closing of door 28.

However, prior to all decision blocks 270–275 being satisfied in the affirmative, the program loops through the reject process of block 280 (see FIG. 13D) which will input to the main loop at block 242 for the purpose of awaiting the insertion of a container, thus the system is inactive until a container is placed in cradle 64 and door 28 is closed.

Once blocks 270 through 275 are satisfied in the affirmative, a shred process commences as indicated at block 286.

Figure 13F:
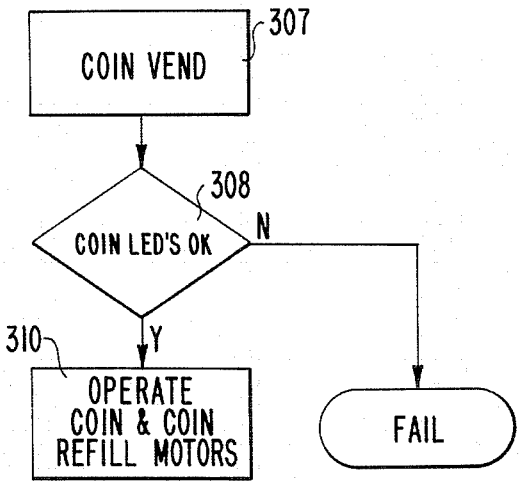
Figure 13E:
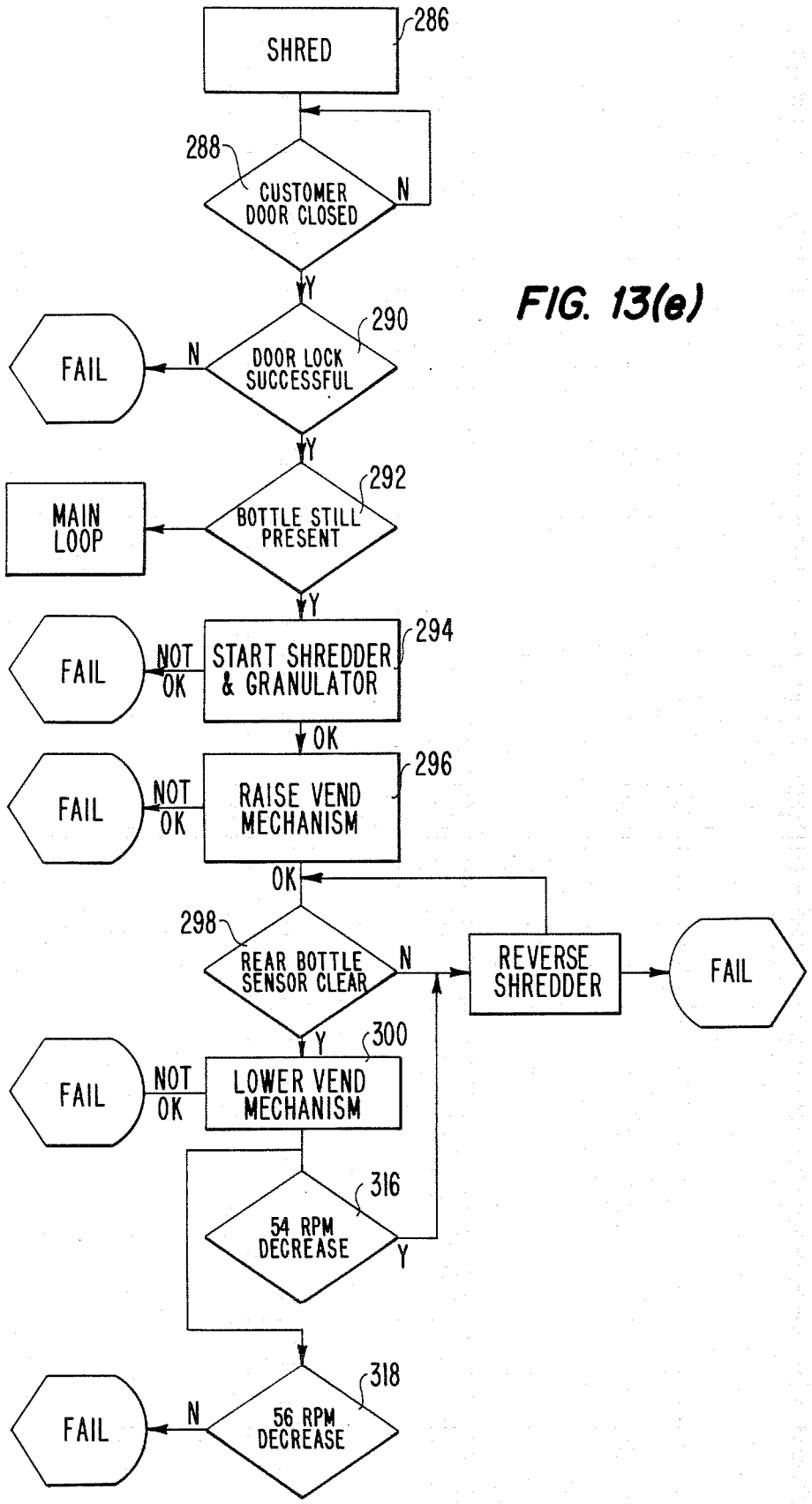

Referring to FIG. 13E the shred process includes checking to determine at block 288 and 290 whether or not customer door 28 is closed and locked; and that a container is still in cradle 64 as required at block 292. Shredder motor 58 and granulator motor 148 are started at block 294. The shredder motor 58 and granulator motor 148 are both operated for a predetermined time interval after starting. Granulator 56 operates for a short time while shredder 54 ceases operation to ensure that the container is completely comminuted. When block 294 indicates start up, cradle 64 is moved to the UP position at block 296 to dump the container end first into the mouth of the shredder 54 to be engaged at diametrically opposite sides by feeder blades 102. If rear acoustic sensor indicates at block 298 that the container has entered feeder blades 102, and does not block the mouth of the shredder cradle 64 is lowered to the normal or down position as shown at blocks 300. If no container is in the cradle 64 as determined at decision block 302 (see FIG. 13C), mechanical counter 172 is incremented (see FIG. 10).

In the event that a container clears rear acoustic sensor 60, but shredder motor 58 experiences a reduction in speed, motor 58 reverses for a designated interval such as one-half second in an attempt to clear the potentially jammed shredder. If it does not clear after several attempts, it goes into failure mode. If the rotation of motor 148, which is checked preferably at one second intervals during operation, does not experience a reduction in speed from one time interval to the next, it is assumed that no container has reached the shredder 56, and the machine goes into failure mode. Bin full sensor 94 is checked at block 304. If not activated, the program returns to main loop 242 where a coins vend process and/or coupons vend process are carried out at blocks 306 and 307 (see FIG. 13A) provided all other conditions are met as previously described.

Referring to FIG. 13F, coin vend process 307 includes checking the coin supply at blocks 308 and refilling coin dispenser 42 at block 310; and then returning to the main program. Coupon vend process 306 is shown carried out in FIG. 13G where the dispenser motor is turned on and off at blocks 311 and 312 after checking dispenser 44 at block 314.

As is clearly shown in FIGS. 13A–13G in the event certain conditions are not satisfied the machine goes into a failure mode and turns off or other corrective action may be taken.

In summary, the plastic bottle container of the present invention is designed especially for use by the public in locations where deposits have been paid on plastic bottles. As previously described, the machine accepts plastic bottles and can pay the customer in both cash and incentive coupons. The operation of the machine is controlled by a microprocessor. The software directs a laser to read a universal product code (UPC) on bottles inserted by a customer. Unacceptable UPC's and objects without a UPC are rejected. If a UPC is read and is acceptable, the bottle is shredded and the plastic dropped into collecting boxes. Payment may be made to the customer in a conventional manner using up to three coin denominations. In addition, a bonus payment may be made in the form of coupons, with the frequency of payment being based on the number of bottles collected by well known apparatus.

The input/output box or microprocessor/controller, contains the microprocessor, the memory, and the software controlling the machine.

When a bottle is inserted through the customer door 28, it is positioned on cradle 64 at an inclination of approximately 30°. When door 28 is closed, the spinner and laser are turned on and an attempt is made to read the UPC. If no UPC is found, an indicator lamp instructs the customer to remove the bottle. The "Machine Ready" lamp is selected and the process repeated as soon as the door 28 is opened. If no UPC match is found, the display panel 39 indicates that the bottle is not an acceptable participating deposit container and must be removed. The light will remain on until the door is opened. If the UPC is determined to be acceptable, the container is comminuted and stored.

When the customer door is properly locked, the shredder is started, and cradle 64 is raised to the full-up position and paused to permit the container to slide free of the vend mechanism into shredder 54 end first. Rear sensor 60, is monitored until it indicates that the container has cleared the mouth of the shredder. Cradle 64 is then returned to the down position. Customer door 28 is then unlocked and the "machine ready" light comes on to prompt the customer to insert the next bottle.

In the event of a malfunction between the time a container slides off cradle 64 and it is shredded, the machine is further protected in accordance with the rotational speed of the shredder 54 and the granulator 56. In the event that the granulator speed does not change after it has been operating a predetermined length of time, the machine goes into the fail mode and shuts off. However, in the event that the shredder does experience a predetermined speed decrease, the shredder motor 58 is reversed, and the machine goes into the failure mode. Further, in the event that the storage bin should become full, the condition is detected and further containers are not accepted by the machine. Thus, from the foregoing it is seen that a container is monitored throughout its entire travel from the time the door is opened to place a container in cradle 64 of the vend mechanism 48 until it is stored in a comminuted condition in storage bins 74; and at any point during such travel, should there be an abnormal operation the machine is put into a failure mode or other corrective action is taken.

It will be apparent to those skilled in the art that various modifications and variations can be made in the reverse vending machine of the present invention without departing from the spirit or scope of the present invention. Thus, it is intended that the present invention cover the modifications and variations of this invention provided they come within the scope of the appended claims or their equivalents.

What is claimed is:

1. A reverse vending machine for accepting and comminuting containers having a uniform product code imprinted thereon, comprising:

a housing having a door operative when opened to receive a container and having a dispensing mechanism for issuing consideration at times following the subsequent closing of said door;

supporting means pivotably mounted for supporting a plastic container in said housing, said means being operable when activated to shift between a first and second position to shift the position of the container to a selected position;

first means for detecting the presence of a container in said supporting means;

means cooperating with said supporting means for weighing and rotating a container in said supporting means;

means disposed to read the uniform product code of a container in said supporting means;

first cutting means when activated for slicing a container into a plurality of elongated strips having a predetermined width;

second means when activated for detecting the entrance of a container into said first cutting means;

second cutting means when activated for cutting each of said strips into a plurality of pieces;

feeding means disposed between said supporting means and said first cutting means operative when activated for feeding a container into said first cutting means;

storing means for collecting the pieces from said second cutting means; and control means including means for activating said feeding means and said first and second cutting means in response to the locking of said door.

2. A reverse vending machine as recited in claim 1, wherein the feeding means are disposed adjacent the selected position to physically engage an accepted container to force the container into the first cutting means.

3. A reverse vending machine as recited in claim 2, wherein said feeding means includes a pair of parallel rotatable shafts, each having a plurality of axially spaced saw tooth projections for engaging the container; and means for rotating said parallel shafts in opposite directions to force a container into the first cutting means.

4. A reverse vending machine as recited in claim 3, wherein the saw tooth projections each have an apex forming an interior angle of approximately sixty degrees.

5. A reverse vending machine as recited in claim 3, wherein said first cutting means includes a rotatable shaft having axially spaced cutting blades mounted thereon

6. A reverse vending machine as recited in claim 5, wherein each cutting blade includes circumferentially spaced teeth for engaging, propelling and cutting the containers.

7. A reverse vending machine as recited in claim 1, wherein in said second cutting means includes a stationary blade having a cutting edge extending in a direction substantially transverse to the longitudinal cut of the strips as said strips enter the second cutting means; and rotatable cutting means for engaging said stationary blade for repeatedly cutting each of said strips substantially transverse to said longitudinal cut of said strips as they enter said second cutting means.

8. A reverse vending machine as recited in claim 7, wherein said rotatable means includes a shaft mounted to rotate on an axis extending substantially orthogonal to the longitudinal cut of the strips as they enter the second cutting means, a blade having a cutting edge mounted on said shaft and extending along the peripheral surface in a direction at an angle to the axis of said shaft for engaging each of the strips in a shearing motion as the shaft rotates.

9. A reverse vending machine as recited in claim 1, wherein the storing means includes a container and a deflector plate positioned to intercept the cut pieces from the second cutting means for distributing the cut pieces over an enlarged area of the container.

10. A reverse vending machine as recited in claim 1, wherein said control means further comprises:

means to detect a bin full condition of the storing means and means responsive to said detected bin full condition to render inoperative the supporting means, the feeding means, and the first and second cutting means.

11. A reverse vending machine as recited in claim 1, wherein said control means further comprises:

means for inactivating the feeding means and the first and second cutting means at a predetermined time following activation.

12. A reverse vending machine as recited in claim 1, wherein the control means includes means responsive to the absence of a decrease in the speed of operation of the second cutting means for ceasing operation of the first and second cutting means.

13. A reverse vending machine for accepting and comminuting containers having a uniform product code imprinted thereon, comprising:

a housing having a door operative when opened to receive a container and having a dispensing mechanism for issuing consideration at times following the subsequent closing of said door;

supporting means pivotably mounted for supporting a plastic container in said housing, said means being operable when activated to shift between a first and second position to shift the position of the container to a selected position;

first means for detecting the presence of a container in said supporting means;

means cooperating with said supporting means for weighing and rotating a container in said supporting means;

means disposed to read the uniform product code of a container in said supporting means;

cutting means when activated for comminuting a container into a plurality of pieces;

second means when activated for detecting the entrance of a container into said cutting means;

feeding means disposed between said supporting means and said cutting means operative when activated for feeding a container into said cutting means;

storing means for collecting the pieces from said cutting means; and control means including means for activating said feeding means and said cutting means in response to the locking of said door.

14. A reverse vending machine recited in claim 13 wherein said control means further comprises:

means for rendering the dispensing mechanism inoperative when the activated second detecting means fails to detect a container entering the cutting means.

15. A reverse vending machine as recited in claim 13, wherein said first detection means includes sending an acoustic signal along the longitudinal axis of the supporting means to detect the presence of different length containers supported in the supporting means.

16. A reverse vending machine as recited in claim 13, wherein said control means further comprises means to operate the feeding means and the cutting means at substantially the same speed.

17. A vending machine recited in claim 13, wherein said control means further comprises:

means to render inoperative the supporting means, the feeding means, and the cutting means upon detection of a container exceeding a predetermined weight.

18. A reverse vending machine as recited in claim 13, wherein the control means includes means responsive to the detection by the second detection means of a container blocking the feeding means for reversing the direction of the cutting means.

19. A reverse vending machine as recited in claim 3, wherein the control means includes means responsive to a decrease in the speed of operation of the cutting means for reversing the operation of the cutting means.

20. A method of reverse vending and comminuting a container having a uniform product code affixed to its peripheral surface comprising the steps of:

receiving a container in a receptacle, the receptacle having an axis extending lengthwise through the mouth end and bottom end of the container supported therein;

weighing the container in said receptacle;

directing an acoustic signal in a direction substantially parallel to the axis of the receptacle to detect the presence of the container in said receptacle;

spinning the container about said axis to move the uniform product code past a scanner for identifying the container;

issuing consideration and dumping the container from said receptacle in response to a selected weight, selected uniform product code, and detected presence:

catching the dumped container adjacent one of its ends;

feeding the caught end of the container into a comminuter;

comminuting the container into pieces of a predetermined dimension; and collecting said pieces.

21. A method of reverse vending and comminuting a container having a uniform product code affixed to its peripheral surface comprising the steps of:

receiving a container in a receptacle, the receptacle having an axis extending lengthwise through the mouth end and bottom end of the container supported therein;

weighing the container in said receptacle;

directing an acoustic signal in a direction substantially parallel to the axis of the receptacle to detect the presence of the container in said receptacle;

spinning the container about said axis to move the uniform product code past a scanner for identifying the container;

issuing consideration and dumping the container from said receptacle in response to a selected weight, selected uniform product code, and detected presence;

catching the dumped container adjacent one of its en feeding the caught end of the container into a shred for slicing the container in a direction substantially parallel to the axis of the container to reduce the container to elongated strips of a predetermined width;

cutting each of said elongated strips into a plurality of pieces; and collecting said pieces.

22. A reverse vending machine comprising:

a feeding device including a pair of spaced rotatable shafts, a plurality of radially extending paddles mounted on each shaft, each paddle having an outer edge and a radial dimension for being adjacently spaced from an outer edge of an opposing paddle of another shaft of said pair;

means rotatably mounting said shafts to rotate in opposite directions in a predetermined angular position relative to one another, said predetermined angular position placing each of the paddles on one shaft parallel to a paddle on said other shaft at times when said paddles extend in a substantially vertical direction;

cutting means disposed intermediate said shafts below the outer edges of said paddles for receiving and cutting a container into a plurality of pieces;

cradle means positioned above said feeding device operative to dump a container between the paddles of said rotatable shafts;

means for rotating said shafts in a direction for forcing a dumped container into said cutting means;

first means for detecting the presence of a container in the cradle means;

second means for detecting the presence of a container being dumped from said cradle means and fed into said feeding device;

first control means responsive to the detection of a container by said second means blocking the feeding device for reversing the operation of said cutting means; and second control means responsive to a decrease in the speed of operation of said cutting means for reversing the operation of said cutting means.

23. A reverse vending machine comprising:

a feeding device including a pair of spaced rotatable shafts, a plurality of radially extending paddles mounted on each shaft, each paddle having an outer edge and a radial dimension for being adjacently spaced from an outer edge of an opposing paddle of another shaft of said pair;

means rotatably mounting said shafts to rotate in opposite directions in a predetermined angular position relative to one another, said predetermined angular position placing each of the paddles on one shaft parallel to a paddle of said other shaft at times when said paddles extend in a substantially vertical direction;

first cutting means disposed intermediate said shafts below the outer edges of said paddles for receiving and cutting a container into strips;

second cutting means disposed below said first cutting means receiving said strips and for cutting each strip into a plurality of pieces;

cradle means positioned above said feeding device operative to dump a container between the paddles of said rotatable shafts;

means for rotating said shafts in a direction for forcing a dumped container into said cutting means;

first means for detecting the presence of a container in the cradle means;

second means for detecting the presence of a container being dumped from said cradle means and fed into said feeding device;

first control means responsive to the detection of a container by said second means blocking the feeding device for reversing the operation of said first cutting means;

second control means responsive to a decrease in the speed of operation of said first cutting means for reversing the operation of said first cutting means; and third control means responsive to the absence of a decrease in the speed of operation of the second cutting means for ceasing operation of the first and second cutting means.

* * * * *